United States Patent [19]

Johnson

[11] 4,456,907

[45] Jun. 26, 1984

[54] IONIZATION TYPE SMOKE DETECTOR WITH TEST CIRCUIT

[75] Inventor: Robert E. Johnson, Pembroke, Mass.

[73] Assignee: Pyrotector, Inc., Hingham, Mass.

[21] Appl. No.: 487,356

[22] Filed: Apr. 26, 1983

Related U.S. Application Data

[63] Continuation of Ser. No. 224,387, Jan. 12, 1981, abandoned.

[51] Int. Cl.[3] ..... G08B 17/10

[52] U.S. Cl. ..... 340/629; 340/514; 250/385; 250/381

[58] Field of Search ..... 340/628, 629, 514; 250/381, 382, 384, 385; 200/61.89

[56] References Cited

U.S. PATENT DOCUMENTS

| | | | |
|---|---|---|---|
| 3,235,858 | 2/1966 | Mäder | 340/630 X |
| 3,304,381 | 2/1967 | McAnespey | 200/61.89 |
| 3,588,892 | 6/1971 | Scheidweiler | 340/629 X |
| 3,812,362 | 5/1974 | Larsen et al. | 340/629 X |
| 3,935,466 | 1/1976 | Tomtoka | 340/629 X |
| 4,238,788 | 12/1980 | Rosauer et al. | 340/629 X |
| 4,336,455 | 6/1982 | Bryant | 250/385 |

*Primary Examiner*—John W. Caldwell, Sr.
*Assistant Examiner*—Daniel Myer

[57] ABSTRACT

An ionization detector of the type having a housing with electrodes and a radiation source for causing ion current flow between the electrodes, collector means for detecting, by a change in voltage, a drop in ion current flow, and means responsive to a predetermined change in collector voltage to provide an output signal, in which a test electrode is provided in the housing and means is provided for applying to the test electrode a predetermined voltage of a value that causes said predetermined change in voltage at the collector, whereby said output signal is provided when said predetermined voltage is applied to the test electrode if said detector is operating satisfactorily.

12 Claims, 4 Drawing Figures

IONIZATION TYPE SMOKE DETECTOR WITH TEST CIRCUIT

This is a continuation of application Ser. No. 224,387, filed Jan. 12, 1981, now abandoned.

BACKGROUND OF THE INVENTION

Ionization detectors are designed to provide an output signal to actuate an alarm when smoke concentration at the detector reaches a predetermined value, by detecting the reduction of ion current in the chamber caused by the presence of smoke particles. In a single chamber detector, in which the chamber electrodes are connected in series with a resistor across a power source, the change in ion current flow changes the voltage at the junction between the detector and the resistor. In a two chamber detector, having a detection chamber and a closed reference chamber connected in series across a power source, the reduction of ion current caused by smoke entering the detector chamber changes the voltage at the junction of the chambers. In a dual chamber detector, in which the reference chamber (or reference volume) is disposed within the detector chamber with a common ion source, a collector electrode is provided in the chamber between the inner and outer electrodes (sometimes forming the separation between the two chambers), and the reduction in ion current flow changes the voltage on the collector electrode. This change in voltage is utilized to actuate an alarm.

Any of the above systems must be calibrated so that the alarm output signal is provided at a definite predetermined smoke concentration. This smoke concentration provides a particular voltage at the detector.

It has been common practice to test such detectors by connecting the reference electrode to ground, or to provide a slowly increasing voltage across the smoke detecting chamber, and determining the voltage at which the alarm signal is produced. It has also been suggested that a test electrode may be provided in the smoke chamber, to be connected to ground or to a voltage varying device, to cause the alarm test signal.

SUMMARY OF THE INVENTION

In accordance with this invention, an ionization smoke detector may be provided with a test electrode in the detector chamber, and means provided for applying to the test electrode a single predetermined voltage, having a value such that it will, in effect, simulate the presence of smoke in the chamber of an amount to which the detector should respond. For example, if it is intended that the detector should produce an alarm signal when the smoke concentration reaches 1% obscuration (1% of the light passing through a column of smoke 1 foot long is absorbed) the presence of this concentration of smoke causes a certain change in the voltage at the collector or at the junction, depending on the type of detector. Therefore the test circuit is designed to apply to the test electrode a voltage of a value such that it causes this voltage change to occur at the collector or junction.

The test circuit is also designed to apply the test voltage in such a manner that voltage surges that might provide a false indication of satisfactory operation do not occur.

In one embodiment of the invention means is provided for applying the test voltage from a remote location.

DESCRIPTION OF THE ILLUSTRATED EMBODIMENTS

Figure 1:
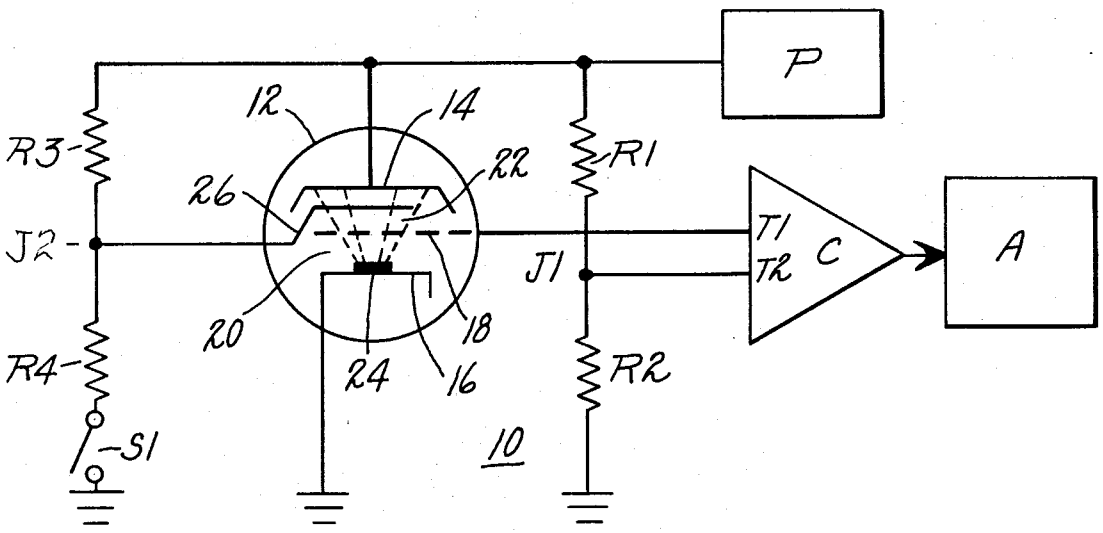
FIG. 1 is a schematic view of an ionization detector embodying the features of the invention, in which the detector is provided with a test electrode and means for applying a predetermined voltage to the test electrode to simulate a predetermined amount of smoke in the chamber.

Referring to FIG. 1 of the drawing, there is illustrated a schematic diagram of an ionization smoke detector 10 which comprises a housing 12 having an inner electrode 16, an outer electrode 13, and a collector electrode 18. The physical structure of such detectors provides an inner or reference chamber 20 between the inner electrode 16 and the collector electrode, and an outer or smoke detecting chamber 22 between the reference electrode and the outer electrode 14. The physical structure of such detectors is well known in the art, and are illustrated in, for example, U.S. Pat. No. 3,935,466 and United Kingdom published application No. 2,013,393A. An ionization source 24 is provided in the housing to provide ion current flow when the detector is connected to a power source P. The outer electrode 14 and the inner electrode 16 are connected across the power source so that ion current flow of a definite magnitude flows between the inner and outer electrodes when clean air is in the detector.

This ion current flow establishes a voltage on the collector electrode of predetermined value, which voltage is applied to terminal T1 of a comparator C, to be compared with a reference voltage established at terminal T2 from the junction J1 of a voltage divider consisting of resistors R1 and R2 connected in series across the power source P.

When smoke enters the chamber, the smoke particles reduce the ion current flow, which reduces the voltage on the collector electrode. For example, in a particular detector, with a supply voltage of 9 volts, the voltage on the collector electrode during clean air conditions, may be 5.5 volts. The resistors R1 and R2 have values such that the voltage on terminal T2 of the comparator is 4.5 volts. Therefore when the smoke density in the chamber becomes great enough to reduce the collector voltage to 4.5 volts, the comparator produces an output to the alarm actuating device A.

In the detector of this invention, a test electrode 26 is provided in the housing between the collector and the outer electrode, in the smoke detecting chamber. To apply a predetermined voltage to the test electrode, a voltage divider is provided, which consists of resistors R3 and R4 in series through a junction J2 and in series with a switch S1 across the power source P, with the test electrode being connected to the junction J2.

The test electrode is normally maintained at the same potential as the outer electrode, since it is connected to the outer electrode and the power source through resistor R3, and since no substantial current flows through said resistor when the switch S1 is open.

However when switch S1 is closed, current through R3 and R4 establish a predetermined voltage on the test electrode that is less than the voltage on the outer electrode, which causes a change in the electric field distribution in the chamber between the collector and the outer electrode. This change in field distribution causes a decrease in the voltage on the collector, and if the voltage applied to the test electrode is of the proper value, the collector voltage is reduced to a value just equal to that of the comparator reference voltage. Applying the proper voltage to the test electrode therefore will simulate the amount of smoke in the housing at which the alarm is to be actuated.

Figure 2:
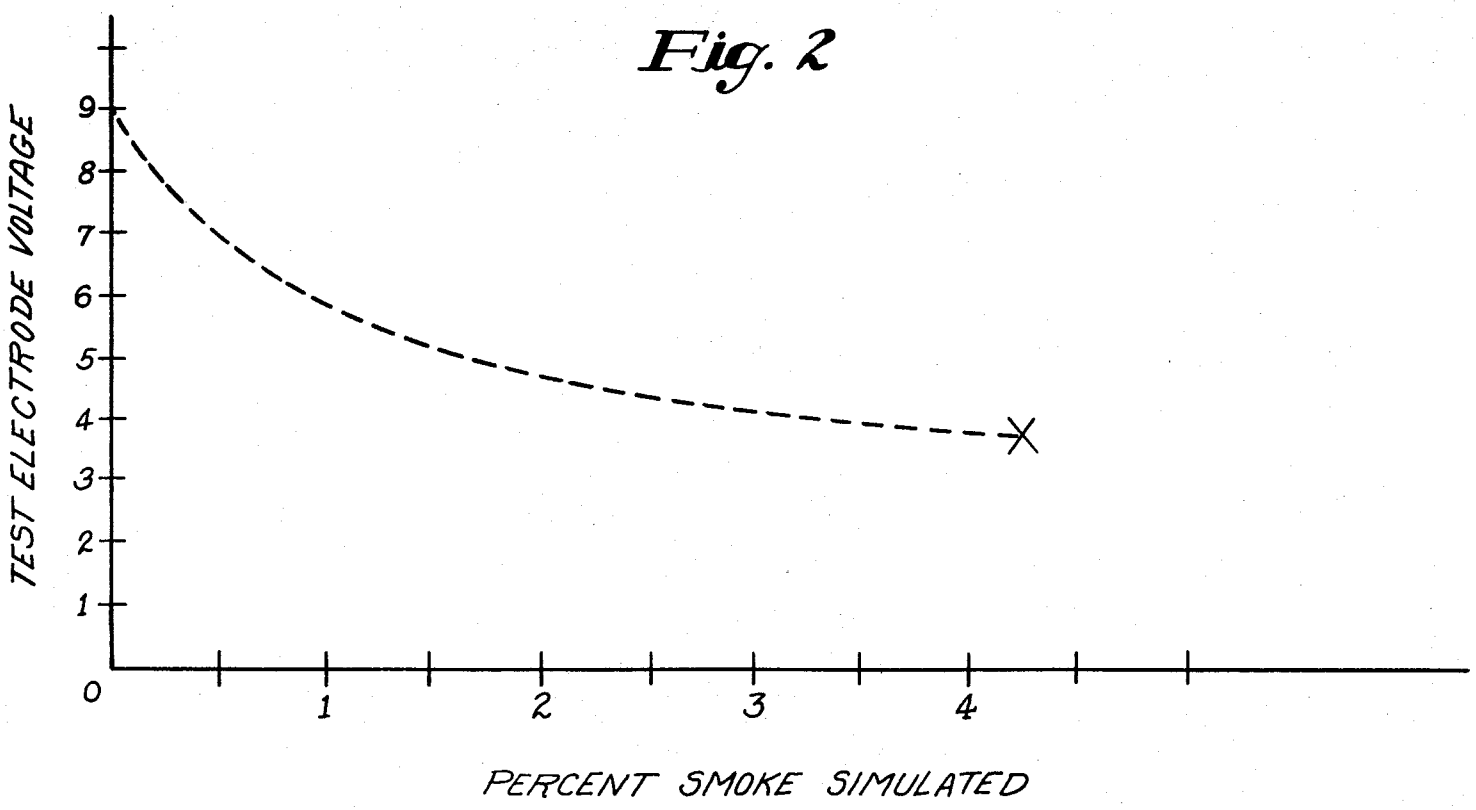
FIG. 2 is a graph illustrating the relationship between the voltage on the test electrode and the percent smoke which said voltage simulates.

FIG. 2 is a graph illustrating the relation between the voltage on the test electrode and the percent smoke that each voltage simulates for a particular detector.

If the detector is intended to provide an alarm signal when the concentration of smoke in the chamber reaches 1% (which is established by the ratio of values of resistors R1 and R2, then it is seen from FIG. 2 that a test voltage of about 5.8 volts will be required to produce a test alarm under clean air conditions. However in the manufacture of such detectors in large quantities manufacturing tolerances make it impractical to test the detectors to the exact alarm point. Therefore if a regulation issued by a government or industry regulatory body requires that the detector respond to 6% smoke for example, the detector can be manufactured to a goal of responding to 1% smoke, with the test circuit being designed to simulate a smoke percentage intermediate the required alarm point of 6% smoke and the designed alarm point of 1% smoke. Therefore the resistors R3 and R3 will have values that will produce a test voltage when switch S1 is closed that will simulate, for example 3% smoke.

In the embodiment of FIG. 1, switch S1 may be a magnetically operated switch so positioned that the test may be conducted by applying a magnet to the exterior of the detector housing. The fact that the switch is in series with the resistors R3 and R4 prevents a surge of current when the switch is closed which might erroneously actuate the alarm circuitry.

Figure 3:
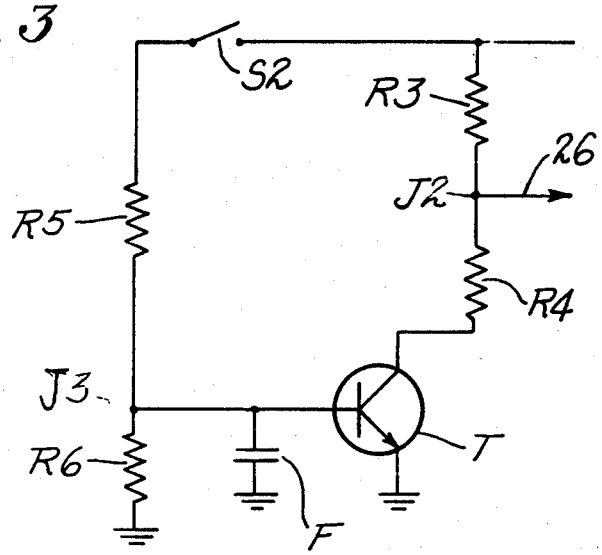
FIGS. 3 and 4 illustrate modified forms of test circuits which allow the detector to be tested from a remote location.

To enable the test to be conducted from a remote location, a modified form of test circuit may be provided as illustrated in FIG. 3. As shown therein, the resistors R3 and R4 are connected in series with the collector-emitter path of transistor T. The base of transistor T is connected to the junction J3 of resistors R5 and R6, which resistors are connected to the power source P through a switch S2, which may be at a remote location such as at a central control panel. Closing of switch S2 causes a predetermined voltage to be applied to the base of transistor T, sufficient to cause conduction in the emitter-collector path so that the test voltage applied at junction J2. If the line from switch S2 to the detector is long enough to voltage transients, a noise suppression capacitor F may be provided between the base of transistor T and ground.

Figure 4:
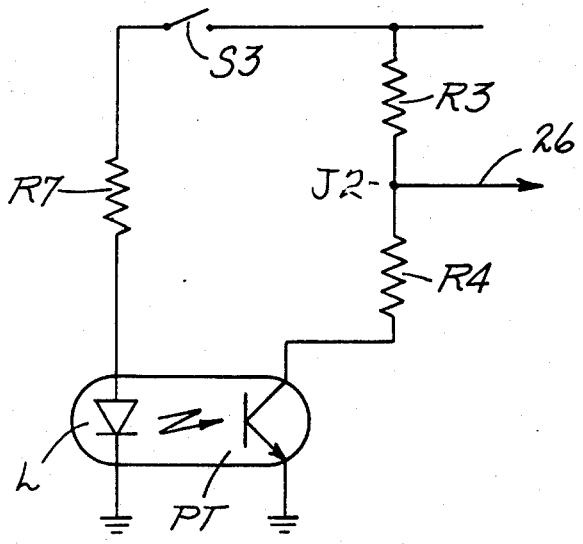

Another embodiment of the invention that allows a remote test switch is shown in FIG. 4, in which resistors R3 and R4 are connected in series with a photo-responsive device, such as photo-transistor PT, of an optically coupled isolator. The light source L of the isolator may be connected to the power source P through a resistor R7 of suitable value, and switch S3. As in the embodiment of FIG. 3, the switch S3 may be located at a remote location. When the switch S3 is closed, the resulting illumination of light L allows conduction through the photo-responsive device to cause the test voltage to appear at junction J2.

Although in the illustrated embodiments of the invention, the test electrode and circuit as shown as being incorporated into a dual chamber detector, the invention can also be incorporated into a single chamber detector or into the detector chamber of a two chamber detector.

Since certain other changes apparent to one skilled in the art may be made in the herein illustrated embodiments of the device without departing from the scope thereof, it is intended that all matter contained herein be interpreted in an illustrative and not a limiting sense.

I claim:

1. An ionization smoke detector comprising first and second electrodes spaced to define therebetween a smoke detecting chamber, a collector electrode in said smoke detecting chamber between said first and second electrodes, an ion source positioned for emitting radiation into said smoke detecting chamber for causing ionization of a gas therein, a power supply connected to said first and second electrodes to establish ion current flow through said smoke detecting chamber, comparator circuitry connected to said collector electrode, said collector electrode being adapted to apply a predetermined voltage to said comparator circuitry during clean air conditions, a first voltage divider network connected to said power supply and to said comparator circuitry, said first voltage divider network generating a reference voltage for application to said comparator circuitry, said reference voltage having a predetermined offset value from said clean air voltage applied to said comparator circuitry by said collector electrode, said comparator circuitry being adapted to generate an alarm signal when the voltage applied to said comparator circuitry by said collector electrode is equal to or less than said reference voltage, a test electrode disposed in said smoke detecting chamber between said first and second electrodes, a second voltage divider network connected to said power supply circuit and to said test electrode, and switch means connected to said second voltage divider network, said switch means having open and closed conditions and being connected to said second voltage divider network such that, when said switch means is in open condition, the voltage applied to said test electrode is the same as the voltage applied to said first electrode by said power supply, and when said switch means is in closed condition a test voltage is applied to said test electrode, said test voltage on said test electrode being effective to reduce the voltage on said collector electrode to a value equal to or less than the said reference voltage to cause said comparator circuit to generate an alarm signal.

2. The ionization detector of claim 1 wherein the test voltage applied to said test electrode when said switch is closed is less than the voltage on said first electrode and greater than the clean air voltage of said collector electrode.

3. The ionization detector of claim 1 wherein said second voltage divider network includes two series-connected resistors, said switch means is connected in series with said two resistors, and said test voltage is generated at the junction of said two resistors.

4. The ionization detector of claim 3 wherein said switch comprises a transistor with the collector-emitter path being connected in series with said two resistors, and means for applying a voltage to the base of the transistor to cause current flow in said collector-emitter path to cause said test voltage to appear on said test electrode.

5. The ionization detector of claim 3 wherein said switch comprises an optically coupled isolator comprising a photo-responsive device connected in series with the second resistor between the test electrode and ground, and a light source positioned to illuminate the photo-responsive device when energized, and means for energizing the photo-responsive device.

6. An ionization smoke detector comprising a housing, inner and outer electrodes spaced in said housing to define therebetween a smoke detecting chamber, a collector electrode in said smoke detecting chamber between said inner and outer electrodes, an ion source positioned in said housing for emitting radiation into said smoke detecting chamber for causing ionization of a gas therein, a power supply connected to said inner and outer electrodes to establish ion current flow through said smoke detecting chamber, comparator circuitry connected to said collector electrode, said collector electrode being adapted to apply a predetermined voltage to said comparator circuitry during clean air conditions, a first voltage divider network connected to said power supply and to said comparator circuitry, said first voltage divider network generating a reference voltage for application to said comparator circuitry, said reference voltage having a predetermined offset value from said clean air voltage applied to said comparator circuitry by said collector electrode, said comparator circuitry being adapted to generate an alarm signal when the voltage applied to said comparator circuitry by said collector electrode is equal to or less than said reference voltage, a test electrode disposed in said smoke detecting chamber between said outer and collector electrodes, said outer, test and collector electrodes being substantially parallel to one another, a second voltage divider network connected to said power supply circuit and to said test electrode, and switch means connected to said second voltage divider network, said switch means having open and closed conditions and being connected to said second voltage divider network such that, when said switch means is in open condition, the voltage applied to said test electrode is the same as the voltage applied to said outer electrode by said power supply, and when said switch means is in closed condition a test voltage is applied to said test electrode, said test voltage on said test electrode being effective to reduce the voltage on said collector electrode to a value equal to or less than the said reference voltage to cause said comparator circuit to generate an alarm signal.

7. The ionization detector of claim 6 wherein said switch is a magnetically operated switch that is operated by applying a magnet to the exterior of the detector housing.

8. The ionization detector of claim 7 wherein the test voltage applied to said test electrode when said switch is closed is less than the voltage on said first electrode and greater than the clean air voltage of said collector electrode.

9. The ionization detector of claim 6 wherein said second voltage divider network includes two series connected resistors, said switch means is connected in series with said two resistors, and said test voltage is generated at the junction of said two resistors.

10. The ionization detector of claim 9 wherein said switch comprises a transistor with the collector-emitter path being connected in series with said two resistors, and means for applying a voltage to the base of the transistor to cause current flow in said collector-emitter path to cause said test voltage to appear on said test electrode.

11. The ionization detector of claim 9 wherein said switch comprises an optically coupled isolator comprising a photo-responsive device connected in series with the second resistor between the test electrode and ground, and a light source positioned to illuminate the photo-responsive device when energized, and means for energizing the photo-responsive device.

12. The ionization detector of claim 9 wherein the test voltage applied to said test electrode when said switch is closed is less than the voltage on said first electrode and greater than the clean air voltage of said collector electrode.

* * * * *

UNITED STATES PATENT OFFICE

CERTIFICATE OF CORRECTION

Patent No. 4,456,907 Dated June 26, 1984

Inventor(s) Robert E. Johnson

It is certified that error appears in the above-identified patent and that said Letters Patent are hereby corrected as shown below:

Under "References Cited", "Tomtoka" should be --Tomioka--

Col. 2, line 25, "electrode 13" should be --electrode 14--.

Signed and Sealed this

*Twenty-sixth* Day of *February 1985*

[SEAL]

*Attest:*

DONALD J. QUIGG

*Attesting Officer* *Acting Commissioner of Patents and Trademarks*